United States Patent [19]

Wells

[11] 4,322,920

[45] Apr. 6, 1982

[54] ROTARY FLOOR CONDITIONING MACHINE ATTACHMENT

[76] Inventor: Raymond E. Wells, Rte. 6, P.O. Box 929, Greer, S.C. 29651

[21] Appl. No.: 89,159

[22] Filed: Oct. 29, 1979

[51] Int. Cl.[3] ..... B24D 17/00; B24B 23/00; A46B 13/02

[52] U.S. Cl. ..... 51/168; 15/180; 15/230.17; 15/246; 51/177; 51/358; 51/376

[58] Field of Search ..... 15/230.17, 230.19, 230, 15/49 R, 50 R, 180, 98, 246; 51/358, 388, 400, 168, 177

[56] References Cited

U.S. PATENT DOCUMENTS

| | | | |
|---|---|---|---|
| 1,958,658 | 5/1934 | Engberg et al. | 15/180 |
| 2,229,250 | 1/1941 | McRae et al. | 15/230.17 |
| 3,022,529 | 2/1962 | Bonfanti | 15/49 R |
| 3,395,417 | 8/1968 | Matouka | 51/358 X |
| 3,527,001 | 9/1970 | Kleemeier et al. | 15/230.17 X |
| 4,114,225 | 9/1978 | Malish et al. | 15/230.17 |
| 4,138,804 | 2/1979 | Thielen | 15/230.17 X |

FOREIGN PATENT DOCUMENTS

| | | | |
|---|---|---|---|
| 878981 | 10/1961 | United Kingdom | 15/230.17 |

*Primary Examiner*—Peter Feldman
*Attorney, Agent, or Firm*—Bailey, Dority & Flint

[57] ABSTRACT

An attachment for use on a rotary floor conditioning machine comprising a master block which is integrally molded of a urethane elastomer including a centrally located hub with a circular flange member extending radially from the base thereof. A plurality of spaced vertically extending tubular receivers are carried on the circular flange. An integrally molded attachment made of urethane elastomer is provided for being attached to the master block through vertically extending posts. Stiff bristles extend out the lower surfaces of the attachment plate. The attachment plate may be molded in two stages so as to produce a stiff upper layer and a more flexible lower layer.

1 Claim, 6 Drawing Figures

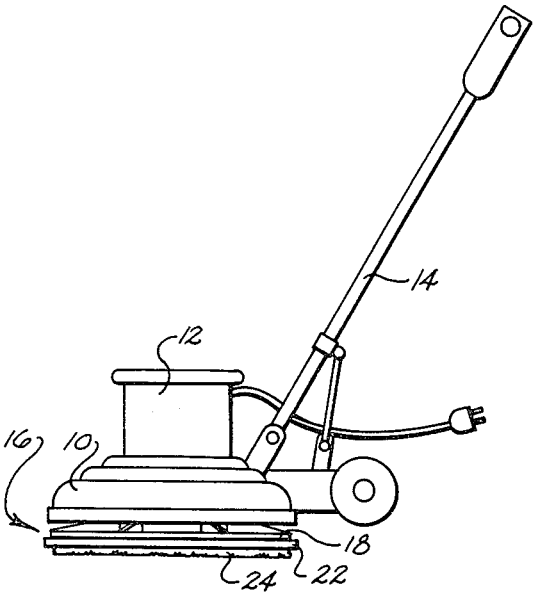
Fig. 1
Fig. 2
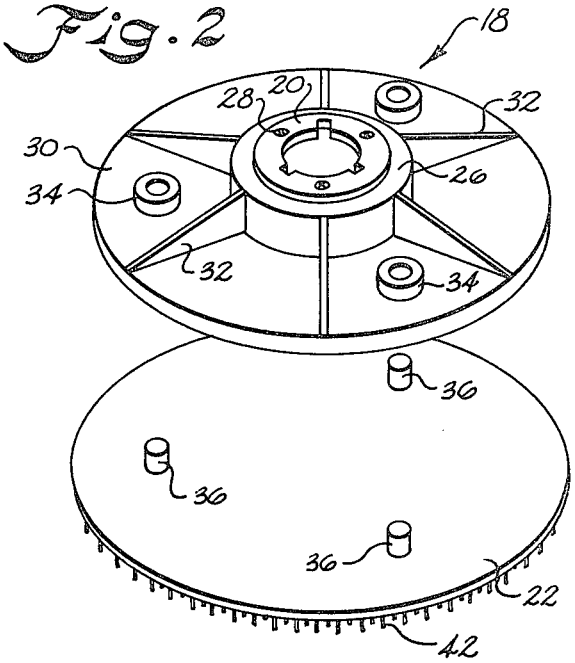
Fig. 3
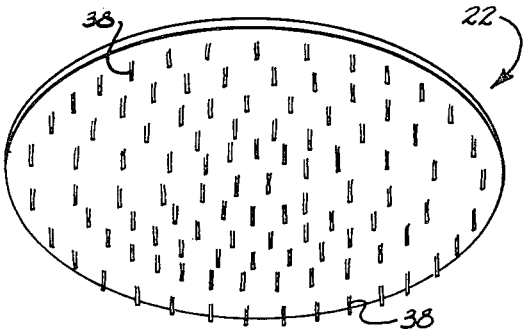
Fig. 4
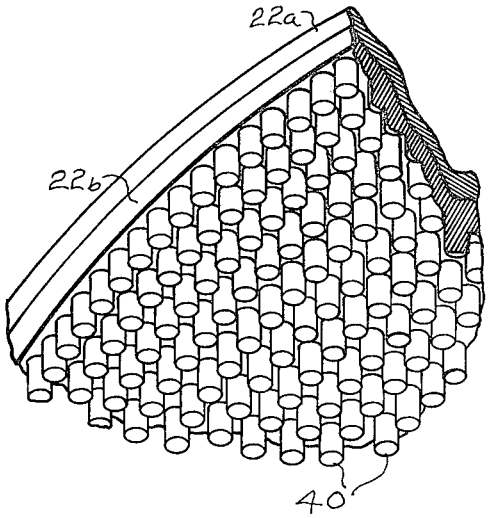
Fig. 6
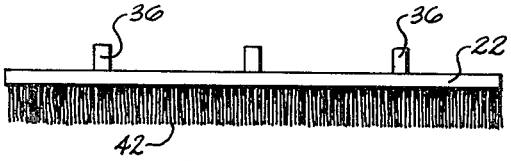
Fig. 5